United States Patent [19]

Minami

[11] Patent Number: 4,880,881

[45] Date of Patent: Nov. 14, 1989

[54] SIZING AGENTS FOR CARBON FIBERS

[75] Inventor: Hiroshi Minami, Aichi, Japan

[73] Assignee: Takemoto Yushi Kabushiki Kaisha, Aichi, Japan

[21] Appl. No.: 195,944

[22] Filed: May 19, 1988

[30] Foreign Application Priority Data

Jun. 16, 1987 [JP] Japan ..... 61-149515

[51] Int. Cl.[4] ..... C08L 63/02; C08K 3/04

[52] U.S. Cl. ..... 525/438; 523/205; 523/402; 523/456

[58] Field of Search ..... 523/205, 456, 402, 512; 525/438

[56] References Cited

U.S. PATENT DOCUMENTS 4,167,538 9/1979 Taniguchi et al. ..... 525/438

4,751,258 6/1988 Minami ..... 523/456

*Primary Examiner*—Lewis T. Jacobs

*Attorney, Agent, or Firm*—Flehr, Hohbach, Test, Albritton & Herbert

[57] ABSTRACT

A sizing agent for carbon fibers has the following three important constituents: an epoxy compound, a copolymer having within its molecule one oxyalkylene derivative of a polycyclic phenol segment and one or two monoester or polyester segments connected through an ester linkage, and oxyalkylene derivative of substituted phenol.

8 Claims, No Drawings

SIZING AGENTS FOR CARBON FIBERS

BACKGROUND OF THE INVENTION

This invention relates to sizing agents for carbon fibers.

Carbon fiber reinforced plastics (hereinafter referred to as FRP) are made from carbon fiber with resin matrix and are one of the most excellent kinds of materials in terms of specific modulus and specific strength. Because of their superior characteristics and light weight, their applications in aerospace industries, as an example, are quickly expanding. Carbon fibers used for the production of FRP are drawn and arranged in the form of a filament or a tow and after they are formed into strands, sheets, textile, or knit materials, they are combined with a resin material and used as a prepreg. Alternatively, filaments or tows may be cut to uniform lengths to produce chopped fibers and after they are combined with a resin material, they may be used as a material for premix, a bulk molding compound or a sheet molding compound. Since carbon fibers are basically brittle, there tend to arise problems of fluffs due to mechanical friction in the molding process before they are made into a prepreg if they are not pretreated with a sizing agent. Moreover, they cannot be handled easily and the physical characteristics of the FRP are also adversely affected. As for chopped fibers, their lengths are usually 1–100 mm but since thousands or tens of thousands of single fibers constitute the carbon fiber filaments or tows which are processed, the fibers become disheveled and bulky and tend to scatter around easily if they are directly chopped without preprocessing. In order to improve the cohesiveness and abrasion resistance of carbon fibers and to make it easier to handle them while they are manufactured or transported, therefore, it has been a common practice to add a sizing agent to carbon fibers but since sizing agents eventually become a part of the produced FRP, it is required that they do not adversely affect the characteristics of the final products.

In view of such requirements as described above, the present invention relates to multi-purpose sizing agents to be combined with a matrix resin and in particular with epoxy resins and unsaturated resins having an ester bond.

As sizing agents for carbon fibers to be used for carbon fiber reinforced epoxy resin, a mixture of liquid and solid bisphenol A diglycidylethers (Japanese Patent Publication Tokko 57-15229, U.S. Pat. No. 3,914,504) and glycidylamines (Japanese Patent Publication Tokko 59-11710, U.S. Pat. No. 4,107,128) have previously been proposed. As sizing agents for carbon fibers to be used for carbon fiber reinforced unsaturated polyester resin, on the other hand, epoxidized polybutadiene (Japanese Patent Publication Tokkai 56-43335) and a mixture of a diglycidylether derived from bisphenol and epichlorohydrin and a prepolymer derived from diallylphthalate (Japanese Patent Publication Tokkai 59-228083) have been proposed. As still another example, sizing agents of the aqueous emulsion type having as indispensable components an epoxy resin, a condensation product of an unsaturated dibasic acid and a bisphenol-type alkylene oxide adduct, and an alkylene oxide adduct of phenol or polycyclic phenol have also been proposed (Japanese Patent Publication Tokko 57-49675, U.S. Pat. No. 4,167,538).

Although these prior art sizing agents each have certain advantages, they have problems regarding the production of FRP and their physical characteristics. For example, since carbon fibers have poor cohesiveness and abrasion resistance, problems of fluff and yarn breakage occur frequently at the time of their weaving and chopped fibers become disheveled. Some are toxic and flammable when exposed to high temperature because of the use of an organic solvent. Some may improve the adhesion between carbon fibers and epoxy resin matrix but not between carbon fibers and unsaturated polyester resin matrix such that interlaminar shear strength (ILSS) of the produced FRP is adversely affected. Sometimes, the attempt at improving the multipurpose characteristics has resulted in insufficient adhesion characteristics regarding both types of resins.

SUMMARY OF THE INVENTION

The present invention provides new sizing agents for carbon fibers which eliminate the aforementioned conventional problems.

This invention has been completed by the present inventor who discovered, as a result of diligent investigations in view of the aforementioned problems, that the use of specified copolymer and specified oxyalkylene derivative of substituted phenol together with epoxy resin provides emulsifiable sizing agents for carbon fibers which can improve the processability of the fibers during the fabrication and have substantially equal adhesion characteristics with epoxy resin matrix and unsaturated polyester resin matrix.

DETAILED DESCRIPTION OF THE INVENTION

This invention relates to sizing agents for carbon fibers containing Compound A, Compound B and Compound C to be defined below as important constituents:

Compound A: Epoxy compound.

Compound B: Copolymer having within its molecule one oxyalkylene derivative of a polycyclic phenol segment and one or two monoester or polyester segments, both segments being connected through an ester linkage and the monoester or polyester segment being obtained by alternately ring-opening addition reaction of organic dicarboxylic anhydride and 1,2-epoxide to oxyalkylene derivative of a polycyclic phenol in the presence of a catalyst.

Compound C: Oxyalkylene derivative of substituted phenol shown by the general formula $$(Y)_n X-O-(\underset{\underset{R}{|}}{CH}CH_2O)_m H$$

where Y is alkyl group, phenyl-methyl group or phenylethyl group with 1–12 carbon atoms, X is benzene residue, diphenyl residue on cumylbenzene residue, R is hydrogen atom or methyl group, n is an integer in the range of 1–5, and m is an integer in the range of 4–100.

Examples of Component A according to the present invention include straight-chain aliphatic epoxy compounds, glycidylether, glycidylamine, glycidylester, glycidylhydantoin, etc. Preferable among these examples are glycidylether and glycidylamine. Particularly preferable examples include bisphenol-A diglycidylether, bisphenol-A diglycidylether polymer, epoxy cresol novolac resins, epoxy phenol novolac resins, N,N,N',N'-tetraglycidyl-m-xylylenediamine, N,N,N',N'-tetraglycidyl diaminodiphenylmethane, N,N,N',N'-tetraglycidylbisaminomethylcylclohexane and m-N,N,-diglycidylaminophenylglycidylether.

Compound B according to the present invention includes within its molecule one oxyalkylene derivative of a polycyclic phenol segment ($B^1$) and one or two monoester or polyester segments ($B^2$), both segments being connected through an ester bond. Thus, Component B of the present invention may be expressed as either $B^1$-$B^2$ or $B^2$-$B^1$-$B^2$.

The aforementioned oxyalkylene derivative of a polycyclic phenol can be obtained, for example, by adding alkyleneoxide to polycyclic phenol by a known method and its molecule has a hydroxyl terminal group which provides active hydrogen. Examples of polycyclic phenolalkyleneoxide derivatives that may be advantageous for use in the present invention include polyoxyalkylene poly(phenyl-methylated) phenylether, polyoxyalkylene poly(phenyl-ethylated) phenylether and polyoxyalkylene bisphenolpolyethylene glycol copolymers. They include the following compounds: polyoxyethylene (5 mole) diphenyl-methylated) cumylphenyl ether, polyoxyethylene (5 mole) tri(phenylmethylated) diphenyl ether, polyoxy (ethylene (2 mole) propylene (2 mole)) tri(phenyl-ethylated) phenylether, polyoxyethylene (10 mole) tri(phenyl-ethylated) phenylether, polyoxypropylene (4 mole) added bisphenol A, polyoxyethylene (2 mole) added bisphenol A, polyoxyethylene (4 mole) added bisphenol S and polyoxyethylene (6 mole) added bisphenol A.

The monoester and polyester segments of Component B according to the present invention can be obtained stably in an industrially advantageous manner by alternately ring-opening addition reaction of organic dicarboxylic anhydride and 1,2-epoxide to aforementioned oxyalkylene derivative of a polycyclic phenol in the presence of a catalyst. In this case, examples of organic dicarboxylic anhydride include aliphatic or ethylenically unsaturated dicarboxylic anhydrides such as succinic anhydride, maleic anhydride and alkenyl succinic anhydride, aromatic dicarboxylic anhydrides such as phthalic anhydride and naphthalene dicarboxylic anhydride, and alicyclic dicarboxylic anhydrides such as cyclohexene dicarboxylic anhydride but ethylenically unsaturated dicarboxylic anhydride is particularly preferable. Examples of 1,2-epoxide include aliphatic epoxides such as ethylene oxide, propylene oxide, 1,2-butylene oxide and alkyl or alkenylglycidylether with 1–12 carbon atoms, aromatic or alicyclic epoxides such as phenylene oxide and cylclohexene oxide, and epoxides having aromatic group such as styrene oxide and phenylglycidyl ether but ethylene oxide, propylene oxide and butylene oxide are particularly preferable. Examples of catalysts include lithium halides such as lithium chloride and lithium bromide and tetra-alkyl quaternary ammonium salts such as tetramethyl ammonium bromide, tetrabutyl ammonium bromide and tetrapropyl ammonium chloride.

The end groups of the monoester and polyester segments thus formed are usually hydroxyl groups, carboxylic groups or a mixture thereof and the ratio thereof as end groups is controlled by the molar ratio between the organic dicarboxylic anhydride and 1,2-epoxide which participated in the reaction. In other words, the ratio of hydroxyl and carboxylic groups as end groups can be varied by selecting the aforementioned molar ratio.

Compounds of Component B according to the present invention having desired characteristics can be obtained by properly selecting the molecular weights of the oxyalkylene derivative of a polycyclic phenol segment and the monoester or polyester segment, their ratio, their structures and their compositions. For example, if the molecular ratio of the monoester or polyester segment is increased, affinity to unsaturated resins having an ester bond as a matrix resin can be improved and if, instead, the molecular ratio of the oxyalkylene derivative of a polycyclic phenol segment is increased, affinity to epoxy resins as a matrix resin can be improved. In order to give reactivity of Component B to other components such as Component A, matrix resins and carbon fibers, various reactive groups may be introduced into the polyester terminal group of Component B. Reactive groups such as ethylenically unsaturated hydrocarbon groups, epoxy groups and isocyanate groups are effective. These reactive groups can be introduced by reacting a reactive substance with the end hydroxyl or carboxylic groups of the polyester segments connected through ether or ester bonds. The end hydroxyl groups of the monoester and polyester segments can also be modified into carboxylic groups by reacting with a polybasic acid (bivalent or greater) or its anhydride. It is effective to have more than 95% of the end groups of the monoester or polyester segment as carboxylic group, including such modifications.

Component C according to the present invention is characterized by the general formula given above and serves as an emulsifier component for emulsifying Components A and B in water. In this formula, the polyoxyalkylene segment is a random or block addition of propylene oxide and/or ethylene oxide. Examples of Component C include addition reaction products of alkyl phenol, phenyl-methylated phenol, phenylethylated phenol, phenyl-ethylated phenylphenol, phenylmethylated cumylphenol or -phenyl-ethylated cumylphenol and propylene oxides and/or ethylene oxide.

The sizing agents of the present invention contain Components A, B and C as important constituents. Depending on the purpose for which they are used, the weight ratios of these components are preferably such that Component A/Component B=10–90/90–10 and Component C/Components A+B=10–40/90–60. If necessary, a lubricant and a surfactant may be contained to the extent of not seriously affecting the effects of the present invention.

The matrix resins to which the sizing agents described above as embodying the present invention are intended to be applied are epoxy resins and unsaturated polyester resins. Epoxy resins include bisphenol A glycidylether, epoxy novolac resins, tetraglycidylamine, and unsaturated polyester resins include unsaturated polyester resins and vinyl ester resins. Unsaturated polyester resins for this purpose are obtained by dissolving in styrene monomer or another polymerizable monomer. More particularly, they are generally polyesters obtainable by using as original material anhydrous maleic acid, orthophthalic acid, isophthalic acid, fumaric acid, ethylene glycol and propylene glycol. Vinyl ester resins have a molecular structure obtainable by a reaction between epoxy resins of bisphenol diglycidylether type or novolac type and acrylic acid or metha-acrylic acid and are mixed with a styrene monomer or the like.

The amount of the sizing agents of the present invention to be applied to carbon fibers is generally 0.1–10 wt % (with respect to carbon fibers) and preferably 0.5–0.7 wt %. Processing is carried out in the form of a water dispersant and the concentration of the sizing agent in the dispersion should preferably be 0.3–5.0 wt %.

The sizing agents of the present invention are extremely effective on carbon fibers from pitch materials or carbon fibers from polyacrylonitril filaments. They can overcome the conventional problems described above and make carbon fibers significantly easier to handle in later processes. Because of their superior cohesiveness and lubricity, problems of fluff and fiber breakage are prevented when carbon fiber filaments and tows are bent many times by guide members and rollers as they are wound or woven, and chopped fibers are prevented from becoming disheveled and scattering around. In summary, the present invention allows carbon fiber yarns to be wound up and woven at a higher speed, makes it easier to cut them cleanly and thereby improves their productivity. Moreover, these sizing agents can be easily applied to carbon fibers as an aqueous emulsion which is uniform and stable, and they are not only safe and hygienically advantageous, but also energy-saving. Carbon fibers processed by the sizing agents of the present invention improve the cohesion not only between the carbon fibers and the epoxy resin matrix but also between the carbon fibers and the unsaturated polyester resin matrix with which prior art sizing agents do not have satisfactory cohesiveness. Thus, sizing agents of the present invention can be used together on these two types of matrix resins to obtain FRP of superior quality from each.

Test experiments using the sizing agents of the present invention are described below in order to better explain the present invention but the present invention is not intended to be limited by these examples.

Examples of Component B are shown in Tables 1 and 2 and sizing agents both embodying the present invention and for comparison were prepared as shown in Tables 3 and 4. Results of tests thereon are shown in Tables 5 and 6.

EXAMPLE 1: PRODUCTION OF COMPONENT B (B-1)

808g (2.0 moles) of ethylene oxide (hereinafter abbreviated as EO) 4 moles adduct of bisphenol, 784 g (8.0 moles) of maleic anhydride and 1.0 g of tetramethylammonium bromide as catalyst were placed inside an autoclave and stirred for 30 minutes at 120°–125° C. Next, 464 g (8.0 moles) of propylene oxide (hereinafter abbreviated as PO) was injected thereinto over a period of 4 hours at 125° C. for a reaction and a light brown viscous liquid (Product B-1 was obtained. For this Product B-1, the acid value was 37, the hydroxyl value was 36 and the molecular weight (hereinafter calculated value) was 1540.

EXAMPLE 2: PRODUCTION OF COMPONENT B (B-7)

After 1540 g (1.0 mole) of Product B-1 and 100 g (1.0 mole) of succinic anhydride were placed inside an autoclave, they were reacted for two hours at 120°–125° C. in the presence of nitrogen gas to obtain a light brown viscous liquid (Product B-7). The ester segment of this Product B-7 has carboxyl terminated polyester segment. Its acid value, hydroxyl value and molecular weight were respectively 67, 2.0 and 1640.

EXAMPLE 3: PRODUCTION OF COMPONENT B (B-10)

After 2349 g (1.0 mole) of Product B-3 obtained in a way similar to Example 1 was dissolved in methylethylketone as a solvent inside a flask, 1.0 g of tetramethylammonium bromide as catalyst and 722 g (1.9 moles) of bisphenol A diglycidylether were successively added thereto and stirred for 3 hours at 60°–70° C. Methylethylketone was distilled away under reduced pressure to obtain a light brown viscous liquid (Product B-10). The ester segment of this Product B-10 has epoxy terminated groups and its acid value, hydroxyl value and molecular weight were respectively 1.2, 3.5 and 3116.

EXAMPLES OF COMPONENT B WITHOUT END MODIFICATION

Product B-2 through B-6 were obtained similarly as explained in Example 1 above.

TABLE 1

| | | Ester Segment Component B | | | | |
|---|---|---|---|---|---|---|
| Product | Derivative Segment of Polycyclic | Organic Dicarboxylic Anhydride (molar ratio) | 1,2-Epoxide | Molecular Weight | Wt % of Ester Segment | Molar Ratio of End Groups COOH/OH |
| B-1 | *1 (1 mole) | MA (4 moles) | PO (4 moles) | 1540 | 59.6 | 50.7/49.3 |
| B-2 | *1 (1 mole) | MA (4.5 moles) FA (4.5 moles) | PO (8.2 moles) | 1852 | 78.2 | 48.5/51.5 |
| B-3 | *2 (1 mole) | MA (12 moles) | PO (11.5 moles) | 2393 | 78.2 | 42.4/57.6 |
| B-4 | *3 (1 mole) | MA (4.5 moles) FA (4.5 moles) | EO (5.5 moles) | 1378 | 69.2 | 45.3/54.7 |
| B-5 | *4 (1 mole) | MA (6 moles) | EO (5.5 moles) | 1478 | 57.7 | 50.2/49.8 |
| B-5 | *5 (1 mole) | MA (7 moles) | EO (6.5 moles) | 1477 | 67.3 | 49.5/50.5 |

Notes:
*1: EO (4 mole) adduct of bisphenol A
*2: EO (4.0 moles) PO (2 moles) random adduct of bisphenol A TABLE 1-continued

*3: EO (4 moles) adduct of bisphenol S
*4: EO (3 moles) PO (1 mole) random adduct of tristyrenated cumylphenol
*5: EO (3 moles) adduct of tribenzylated phenol
Specifically:
*1 bisphenol-A polyethylene glycol (4 moles) copolymer

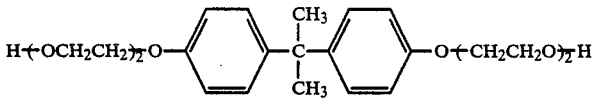

*2 bisphenol-A polyethylene glycol (4 moles) polypropylene glycol (2 moles) random copolymer

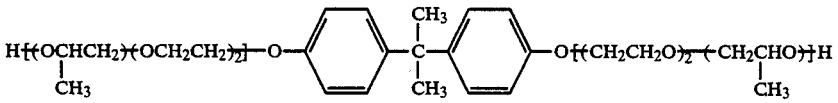

*3 bisphenol-S polyethylene glycol (4 moles) copolymer

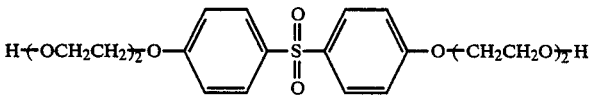

*4 polyoxyethylene (3 moles) oxypropylene tri(phenyl-ethylated) cumylphenylether

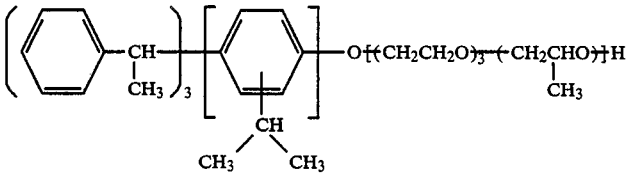

*5 polyoxyethylene (3 moles) tri(phenyl-methylated phenylether

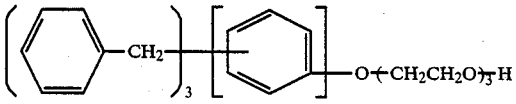

MA maleic anhydride
FA phthalic anhydride

EXAMPLES OF COMPONENT B WITH MODIFICATION

Products B-7 through B-11 were obtained similarly as explained in Example 2 or Example 3 above.

TABLE 2

| Product | Compound B (moles) | Terminating Agent (moles) | End Group: Molar Ratio COOH/OH | End Group: Structure |
|---|---|---|---|---|
| B-7 | B-1 (1 mole) | SA (0.5 mole) | 97.0/3.0 | —COOH/—OH |
| B-8 | B-1 (1 mole) | MA (0.5 mole) | 98.0/2.0 | —COOH/—OH |
| B-9 | B-1 (1 mole) | FA (0.5 mole) | 97.0/3.0 | —COOH/—OH |
| B-10 | B-3 (1 mole) | *6 (2 moles) | | $-CH_2CH(\diagdown O \diagup)CH_2$ |

TABLE 2-continued

| Product | Compound B (moles) | Terminating Agent (moles) | End Group Molar Ratio COOH/OH | End Group Structure |
|---|---|---|---|---|
| B-11 | B-3 (1 mole) | *7 (2 moles) | | $-CH_2CH(OH)CH_2OOC-C(CH_3)=CH_2$ |

Notes:
*6: bisphenol A dyiglycidyl ether
*7: glycidyl metha-acrylate
SA: succinic anhydride

PREPARATION OF SIZING AGENTS

Sizing agents (Test Examples 1–11) shown in Table 3 and those (Comparison Examples 1–9) as shown in Table 4 were prepared.

TABLE 3

| | 1 | 2 | 3 | 4 | 5 | 6 | 7 | 8 | 9 | 10 | 11 |
|---|---|---|---|---|---|---|---|---|---|---|---|
| A-1 | 4.3 | 4.0 | 10.5 | 5.7 | 4.5 | | 4.0 | 5.0 | 4.0 | 3.0 | |
| A-2 | 4.0 | | | 2.0 | | | 4.0 | 3.0 | 4.0 | 5.0 | 4.0 |
| A-3 | | 2.5 | | | 5.0 | 7.0 | | | | | 3.0 |
| B-1 | 9.0 | | | | | | | | | | |
| B-2 | | 11.0 | | | | | | | | | |
| B-3 | | | 6.5 | | | | | | | | |
| B-4 | | | | 10.0 | | | | | | | |
| B-5 | | | | | 8.0 | | | | | | |
| B-6 | | | | | | 10.0 | | | | | |
| B-7 | | | | | | | 9.0 | | | | |
| B-8 | | | | | | | | 9.0 | | | |
| B-9 | | | | | | | | | 9.0 | | |
| B-10 | | | | | | | | | | 9.0 | |
| B-11 | | | | | | | | | | | 10.0 |
| C-1 | 0.2 | | 0.5 | | | | 0.3 | 0.3 | 0.3 | | |
| C-2 | | | 2.5 | | | | | | | | |
| C-3 | 2.5 | 2.5 | | 2.3 | 2.5 | 3.0 | 2.7 | 2.7 | 2.7 | 3.0 | 3.0 |

TABLE 4

| | 1 | 2 | 3 | 4 | 5 | 6 | 7 | 8 | 9 |
|---|---|---|---|---|---|---|---|---|---|
| A-1 | 4.9 | 15.6 | | 10.0 | | | | 20.0 | 10.9 |
| A-2 | 4.6 | | | 10.0 | | | | | |
| A-3 | | | | | | | | | |
| B-1 | 10.5 | | | | 20.0 | | | | |
| B-2 | | | | | | | | | |
| B-3 | | | | | | | | | |
| B-4 | | | | | | | | | |
| B-5 | | | | | | | | | |
| B-6 | | | 15.4 | | | | | | |
| B-7 | | | | | | | | | |
| B-8 | | | | | | | | | |
| B-9 | | | | | | | | | |
| B-10 | | | | | | | | | |
| B-11 | | | | | | | | | |
| C-1 | | 0.7 | | | | | | | |
| C-2 | | 3.7 | | | | | | | 1.9 |
| C-3 | | | 4.6 | | | 20.0 | | | |
| *8 | | | | | | | | | 7.2 |
| *9 | | | | | | | 20.0 | | |
| *10 | | | | | | | 80.0 | | |

TABLE 4-continued

| | 1 | 2 | 3 | 4 | 5 | 6 | 7 | 8 | 9 |
|---|---|---|---|---|---|---|---|---|---|
| *11 | | | | | | | | 80.0 | |

Notes:
Both in Tables 3 and 4, the numbers indicate weight parts. Except in Comparison Examples 7 and 8, water comprises 80 weight parts.
A-1: bisphenol A diglycidylether (Epikote 828 produced by Yuka Shell Chemical Company or Epon 828 produced by Shell Chemical Company, epoxy equivalent 190)
A-2: bisphenol A diglycidylether (Epikote 1002 produced by Yuka Shell Chemical Company or Epon 1002 produced by Shell Chemical Company, epoxy equivalent 630)
A-3: tetraglycidyl diaminodiphenyl methane (Sumiepoxy ELM 434 produced by Sumitomo Chemical Industries Company, epoxy equivalent 120)
C-1: polyoxyethylene (6 moles) nonylphenylether
C-2: polyoxyethylene (70 moles) penta(phenyl-ethylated) cumylphenylether
C-3: polyoxythylene (30 moles) tri(phenyl-methylated) phenylether
*8: condensation product (acid value 50) of 2.0 moles of EO (2 moles) adduct of bisphenol A, 1.5 moles of maleic acid, and 0.50 moles of sebacic acid
*9: epoxidized polybutadiene (BF-1000 produced by Adeka Argus Chemical Company)
*10: acetone
*11: methylethyl ketone

Evaluation

By the methods to be described below, each sizing agent described above was examined in terms of stability of emulsion, fluffs and fiber breakage in carbon fibers sized therewith and inter-laminar shearing strength (hereinafter abbreviated as ILSS) of such carbon fibers. Results of these tests are shown in Table 5. Sheet molding compounds (SMC) were also prepared with such carbon fibers treated with the sizing agents and the bending strengths of these composites were measured. Results of these measurements are shown in Table 6.

TABLE 5

| | Emulsion Stability | Fluffs, Breakage TM | Fluffs, Breakage Rubbing | Epoxy Resins | ILSS ($kg/mm^2$) Vinyl Ester Resins |
|---|---|---|---|---|---|
| 1 | A | A | A | 8.2 | 8.3 |
| 2 | A | A | B | 8.2 | 8.3 |
| 3 | A | A | A | 8.2 | 8.3 |
| 4 | A | A | A | 8.2 | 8.3 |
| 5 | A | A | B | 8.2 | 8.3 |
| 6 | A | A | A | 8.2 | 8.3 |
| 7 | A | A | A | 8.4 | 8.5 |
| 8 | A | A | A | 8.4 | 8.5 |
| 9 | A | A | A | 8.4 | 8.5 |
| 10 | A | A | A | 8.5 | 8.5 |
| 11 | A | A | A | 8.4 | 8.6 |
| 1 | ** | — | — | — | — |
| 2 | A | D | C | 7.7 | 7.0 |
| 3 | B | C | B | 7.9 | 8.2 |
| 4 | ** | — | — | — | — |
| 5 | ** | — | — | — | — |
| 6 | A | D | D | 6.4 | 6.5 |
| 7 | — | D | D | 7.5 | 7.0 |
| 8 | — | B | C | 7.8 | 7.1 |

TABLE 5-continued

| | Emulsion Stability | Fluffs, Breakage TM | Fluffs, Breakage Rubbing | Epoxy Resins | ILSS (kg/mm²) Vinyl Ester Resins |
|---|---|---|---|---|---|
| 9 | A | C | B | 7.8 | 7.9 |

Note:
**indicates no emulsification

TABLE 6

| | Bending Strength (kg/cm²) | Bending Modulus (kg/cm²) |
|---|---|---|
| Test Examples | | |
| 1 | $14.5 \times 10_2$ | $8.6 \times 10^4$ |
| 3 | $14.4 \times 10^2$ | $8.5 \times 10^4$ |
| 8 | $14.8 \times 10^2$ | $8.8 \times 10^4$ |
| 10 | $14.8 \times 10^2$ | $8.9 \times 10^4$ |
| 11 | $15.2 \times 10^2$ | $9.0 \times 10^4$ |
| Comparison Examples | | |
| 1 | $13.5 \times 10^2$ | $6.8 \times 10^4$ |
| 3 | $13.8 \times 10^2$ | $7.5 \times 10^4$ |

Superior effects obtainable by the present invention are clearly demonstrated in Tables 5 and 6.

Methods of Evaluation and Measurements (1) Emulsion Stability

Each solution of sizing agent with concentration of 20% was left for 7 days at 20° C., its separation was evaluated as follows:

A: No separation

B: Creamy floating substances

Sizing Treatment of Carbon Fibers (2-1) No-size yarns of carbon fibers (7μ/6000 filaments) were dipped into a solution of each sizing agent for impregnation such that the effective amount that was attached became 1.2 wt %. After they were wrung by rollers and dried, they were subjected to a heat treatment at 150° C. for 10 minutes inside an oven and collected by winding.

(2-2) No-size yarns of carbon fibers (7μ/3000 filaments) were dipped into a solution of each sizing agent for impregnation such that the effective amount that was attached became 3.5 wt %. After they were wrung by rollers and dried, they were subjected to a heat treatment at 150° C. for 20 minutes inside an oven and chopped to lengths of 1 inch to produce chopped fibers.

(3) Fluffs and Breakage

A TM type yarn friction and rubbing tester (produced by Daiei Kagaku Seiki Company) was used to test the fiber-metal friction of the carbon fibers treated according to (2-1) with a load of 100g/6000 filaments, $\Theta=150°$, length of frictional motion=30 mm and a metallic comb moved 500 times reciprocatingly at the rate of 150 times/min. Separately, a rubbing tester (produced by Toyo Seiki Company) was used to test the fiber-fiber friction with internal angle of about 35°, one twist, length of frictional motion =20 mm and 500 times of reciprocating motion at the speed of 100 times/min. The results of these tests were evaluated as follows:

A: Hardly any fluffs or yarn breakage

B: Fluffs appearing only singly

C: Fluffs and breakage occurring in groups

D: Frequent occurrence of fluffs and yarn breakage and cutting in one part.

(4) Measurement of ILSS (4-1) When an Epoxy Resin was Used as Matrix Resin

After carbon fibers sized according to (2-1) were impregnated with a resinous composition which comprises 80 weight parts of bisphenol A diglycidyl ether monomer (Epikote 828 produced by Yuka Shell Chemical Company or Epon 828 produced by Shell Chemical Company), 20 weight parts of bisphenol A diglycidylether polymer (Epkote 1002 produced by Yuka Shell Chemical Company or Epon 1002 produced by Shell Chemical Company), 5 weight parts of boron trifluoride monomethylamine and 25 weight parts of methylethyl ketone and methylethyl ketone was removed therefrom, they were partially hardened and a unidirectionally reinforced prepreg was produced. The prepreg thus obtained was cut and placed inside a mold and a composite with $V_f$(volume percentage of carbon fibers therein)=60% was formed by applying a pressure of 7 kg/cm² for 90 minutes at 140° C. The dimensions of the product were 2.5 mm in thickness, 6 mm in width and 17 mm in length. ILSS of this product was measured by the short beam method (ratio of span length/thickness=5).

(4-2) When Unsaturated Resin With Ester Bond Was Used as a Matrix Resin

After carbon fibers size according to (2-1) were impregnated uniformly with a resin mixture composed of 100 weight parts of vinyl ester resin (Ripoxy R-802 produced by Showa Kobunshi Company), 1 weight part of tertiary butylperbenzoate and 1 weight part of butylbenzoylperoxide, a pressure of 7 kg/cm² was applied for 60 minutes at 130° C. in a molding production process and a unidirectionally reinforced prepreg with $V_f$=60% was produced. The dimensions of this product were 2.5 mm in thickness, 6 mm in width and 17 mm in length. ILSS of this product was measured by the short beam method (ratio of span length/thickness=5).

(6) Measurement of Bending Strength

After 40 weight parts of styrene solution with 35% of rubber-type low shrinkage agent, 60 weight parts of styrene solution with 60% of unsaturated polyester resin (Polyset 9109 produced by Hitachi Kasei Company, phthalic ester-type) 1.5 weight parts of tertiary butylperbenzoate, 3.0 weight parts of zinc stearate, 200 weight parts of calcium carbonate powder and 0.3 weight parts of parabenzoquinone were uniformly mixed, 2.0 weight parts of magnesium oxide were added and a composition for SMC (sheet molding compound) containing 20% of a one-to-one mixture of glass fibers of one inch in length and carbon fibers of one inch in length treated according to (2-1) was prepared. This composition was molded at 140 C. and bending strength was tested on this molded product.

What is claimed is:

1. A sizing agent for carbon fibers containing Component A, Component B and Component C as important constituents, Component A being an epoxy compound, Component B being a copolymer having within a molecule one oxyalkylene derivative of a polycyclic phenol segment and one or two monoester or polyester segments, said oxyalkylene derivative of a polycyclic phenol segment and monoester or polyester segments being connected through an ester linkage, said monoester or polyester segment of said Component B being obtained by alternately ring-opening addition reaction of organic dicarboxylic anhydride and 1,2-epoxide to oxyalkylene derivative of a polycyclic phenol in the presence of a catalyst, and Component C being oxyalkylene derivative of substituted phenol shown by the general formula $$(Y)_n X-O-(CH(R)CH_2O)_m H$$

wherein Y is alkyl group, phenyl-methyl group or phenyl-ethyl group with 1–12 carbon atoms, X is benzene residue, diphenyl residue or cumylbenzene residue, R is hydrogen atom or methyl group, n is an integer in the range of 1–5 and m is an integer in the range of 4–100.

2. The sizing agent for carbon fibers of claim 1 wherein Component A includes one or more selected from the group consisting of bisphenol-A diglycidyl ether, bisphenol-A diglycidyl ether polymer, epoxy cresol novolac resins, epoxy phenol novolac resins, N,N,N',N'- tetraglycidyl-m-xylylene diamine, N,N,N',N'-tetraglycidyl diaminodiphenylmethane, N,N,N',N'- tetraglycidyl bis(aminomethyl)cyclohexane and m-N,N,-diglycidylaminophenylglycidyl ether.

3. The sizing agent for carbon fibers of claim 1 wherein said oxyalkylene derivative of a polycyclic phenol segment of said Component B comprises one or more selected from the group consisting of polyoxyalkylene poly(phenyl-methylated) phenylether, polyoxyalkylene poly(phenyl-ethylated) phenylether and bisphenol-polyethylene glycol copolymers.

4. The sizing agent for carbon fibers of claim 1 wherein said organic dicarboxcylic anhydride includes unsaturated dicarboxylic anhydride as indispensable constituent.

5. The sizing agent for carbon fibers of claim 1 wherein said 1,2-epoxide includes one or more selected from the group consisting of ethylene oxide, propylene oxide and butylene oxide.

6. The sizing agent for carbon fibers of claim 1 wherein more than 95 mole % of the terminal groups of said monoester or polyester segment of said Component B is carboxylic group.

7. The sizing agent for carbon fibers of claim 1 wherein the terminal groups of said monoester or polyester segment of said Component B is capped by one or more selected from the group consisting of ethylenically unsaturated group, epoxy group and isocyanate group.

8. The sizing agent for carbon fibers of claim 1 wherein weight ratios are Component A/Component B=10–90/90–10 and Component C/Components A+B=10–40/90–60.

* * * * *